US008157898B2

(12) United States Patent
Fujita et al.

(10) Patent No.: US 8,157,898 B2
(45) Date of Patent: Apr. 17, 2012

(54) CONDENSER

(75) Inventors: Issaku Fujita, Hyogo (JP); Kotaro Machii, Hyogo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 456 days.

(21) Appl. No.: 12/461,389

(22) Filed: Aug. 11, 2009

(65) Prior Publication Data

US 2010/0065253 A1 Mar. 18, 2010

(30) Foreign Application Priority Data

Sep. 16, 2008 (JP) ..... 2008-236568

(51) Int. Cl.
*B01D 53/00* (2006.01)

(52) U.S. Cl. ..... 95/288; 62/55.5; 165/113

(58) Field of Classification Search ..... 95/288; 62/55.5; 165/113, 114
See application file for complete search history.

(56) References Cited

U.S. PATENT DOCUMENTS 5,941,301 A * 8/1999 Baumann ..... 165/114

FOREIGN PATENT DOCUMENTS

JP 07174888 A * 7/1995
JP 2001-153569 6/2001

* cited by examiner

*Primary Examiner* — Robert A Hopkins
(74) *Attorney, Agent, or Firm* — Manabu Kanesaka; Benjamin J. Hauptman; Kenneth M. Berner

(57) ABSTRACT

A condenser having improved condensation performance is provided. The condenser includes a plurality of cooling pipes, being disposed in a chassis to which the steam is introduced, through the interior of which cooling water used for heat exchange with steam flows; an inner channel that extends in a top-bottom direction and that is surrounded by the plurality of cooling pipes; a plurality of pipe-supporting plates disposed at a distance from one another in a direction in which the plurality of cooling pipes extend to support the plurality of cooling pipes; and a water receiving portion disposed between the plurality of pipe-supporting plates and being inclined downward from one pipe-supporting plate to the other pipe-supporting plate.

5 Claims, 7 Drawing Sheets

CONDENSER

BACKGROUND OF THE INVENTION

1. Field of the Invention

The present invention relates to condensers.

This application is based on Japanese Patent Application No. 2008-236568, the content of which is incorporated herein by reference.

2. Description of Related Art

In general, after a steam turbine is driven, moisture contained in the steam discharged from the steam turbine is condensed in a condenser and is collected as condensate water.

Groups of cooling pipes, through which cooling water flows, are disposed in the above-described condenser. The steam introduced into the condenser is cooled and condensed by the cooling water flowing through the cooling pipe groups (for example, see the Publication of Japanese Patent No. 3907894).

While the condensate water resulting from the condensation of the steam as described above is collected from the bottom of the condenser, residual steam after condensation and non-condensable gas, such as air, are guided from an air extracting portion to a vacuum pump disposed outside the condenser.

More specifically, the steam discharged from the steam turbine flows in between the cooling pipe groups of the condenser, is cooled by heat exchange with the cooling water, and is then condensed on the surfaces of the cooling pipes.

The residual steam and non-condensable gas, such as air, flow through inner steam paths formed in the cooling pipe groups, pass through an air cooling portion, and flow into the air extracting portion. Thus, the steam flows smoothly in the cooling pipe groups.

As described above, the condensate water condensed on the surfaces of the cooling pipes falls in the inner steam paths. Then, the fallen condensate water adheres to the cooling pipe groups that are disposed at the lower part of the inner steam paths and discourages the steam from cooling. In other words, there were problems in that an improvement in the steam-condensing performance in the condenser was discouraged.

The present invention has been made to solve the above-described problems, and an object thereof is to provide a condenser having improved condensation performance.

BRIEF SUMMARY OF THE INVENTION

To achieve the above object, the present invention provides the following solutions.

A condenser of the present invention includes a plurality of cooling pipes, being disposed in a chassis to which the steam is introduced, through the interior of which cooling water used for heat exchange with steam flows; an inner channel that extends in a top-bottom direction and that is surrounded by the plurality of cooling pipes; a plurality of pipe-supporting plates disposed at a distance from one another in a direction in which the plurality of cooling pipes extend to support the plurality of cooling pipes; and a water receiving portion disposed between the plurality of pipe-supporting plates and being inclined downward from one pipe-supporting plate to the other pipe-supporting plate.

According to the present invention, the water falling from the cooling pipes is received by the water receiving portion and is allowed to flow down the pipe-supporting plates. Thus, a decrease in heat exchange capacity of the cooling pipes disposed at a lower part can be prevented.

More specifically, the steam introduced in the chassis is cooled on the surfaces of the cooling pipes by heat exchange with the cooling water and is condensed into water. The condensate water falls from the surfaces of the cooling pipes and is received by the water receiving portion. The received water flows along the inclination of the water receiving portion toward the other pipe-supporting plate and flows down the surface of the other pipe-supporting plate.

Thus, the water condensed by the cooling pipes disposed at an upper part is prevented from depositing on the cooling pipes disposed at a lower part. That is, formation of a film of deposited water on the cooling pipes disposed at a lower part is prevented, preventing a decrease in heat exchange efficiency due to the film.

It is preferable that the water receiving portion of the present invention be provided inside the inner channel.

In this structure, the water that has fallen from the surfaces of the cooling pipes disposed at an upper part of the inner channel through the inner channel is received by the water receiving portion. This prevents a decrease in heat exchange capacity of the cooling pipes disposed at a lower part of the inner channel.

It is preferable that the water receiving portion of the present invention be a plate-like member that is bent in a substantially V shape in a sectional view substantially parallel to the pipe-supporting plates.

In this structure, the water received by the water receiving portion gathers at the bottommost position of the substantially V-shaped cross section and flows toward the other pipe-supporting plate. Thus, the water received by the water receiving portion can be assuredly guided to the other pipe-supporting plate.

In the above-described invention, it is preferable that the plate-like member of the water receiving portion have a through-hole penetrating in the top-bottom direction and a projection protruding upward from the circumference of the through-hole.

In this structure, fluid, such as steam, flowing from above to below or below to above in the area where the water receiving portion is disposed flows through the through-hole. This makes it easier for fluid, such as steam, to flow, compared with a case where the through-hole is not provided.

On the other hand, the water received by-the water receiving portion flows so as to avoid the through-hole because of the projection when flowing down the plate-like member of the water receiving portion.

Thus, it is possible to prevent blocking of steam flow in the chassis, as well as to prevent a decrease in heat exchange capacity of the cooling pipes disposed below the water receiving portion.

It is preferable that the water receiving portion of the present invention include, in a sectional view substantially parallel to the pipe-supporting plates, a plurality of corrugated portions, extending in a top-bottom direction and being bent in a corrugated form, which are disposed side by side in a left-right direction and branched portions that are provided near apexes of the corrugated portions and extend upward in a direction away from the corrugated portions.

In this structure, fluid, such as steam, flowing from above to below or below to above in the area where the water receiving portion is disposed flows between the corrugated portions.

On the other hand, the water that has fallen from the surfaces of the cooling pipes disposed above the water receiving portion is received by the corrugated portions and flows down the surfaces thereof, and then enters the spaces between the corrugated portions and the branched portions.

Otherwise, the water is directly received between the corrugated portions and the branched portions. The water between the corrugated portions and the branched portions flows toward the other pipe-supporting plate and flows down the other pipe-supporting plate.

According to the condenser of the present invention, the water falling from the cooling pipes is received by the water receiving portion and is allowed to flow down the pipe-supporting plates. Thus, there is an advantage in that a decrease in heat exchange capacity of the cooling pipes disposed at a lower part can be prevented and the condensation performance of the condenser can be improved.

DETAILED DESCRIPTION OF THE INVENTION

[First Embodiment]

A first embodiment of the present invention will be described below with reference to FIGS. 1 to 6.

Figure 1:
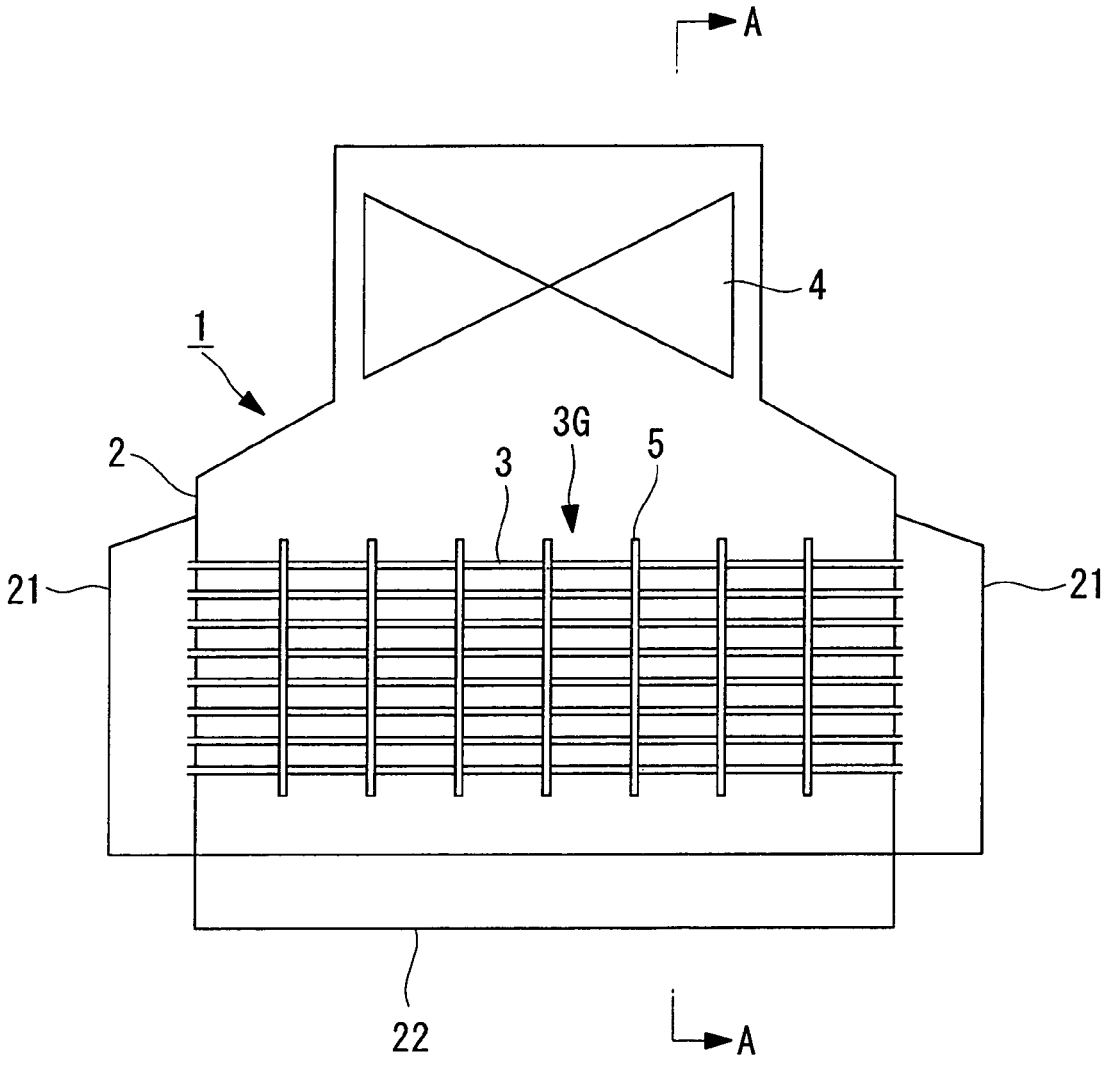
FIG. 1 is a schematic view for explaining the structure of a condenser according to a first embodiment of the present invention.
Figure 2:
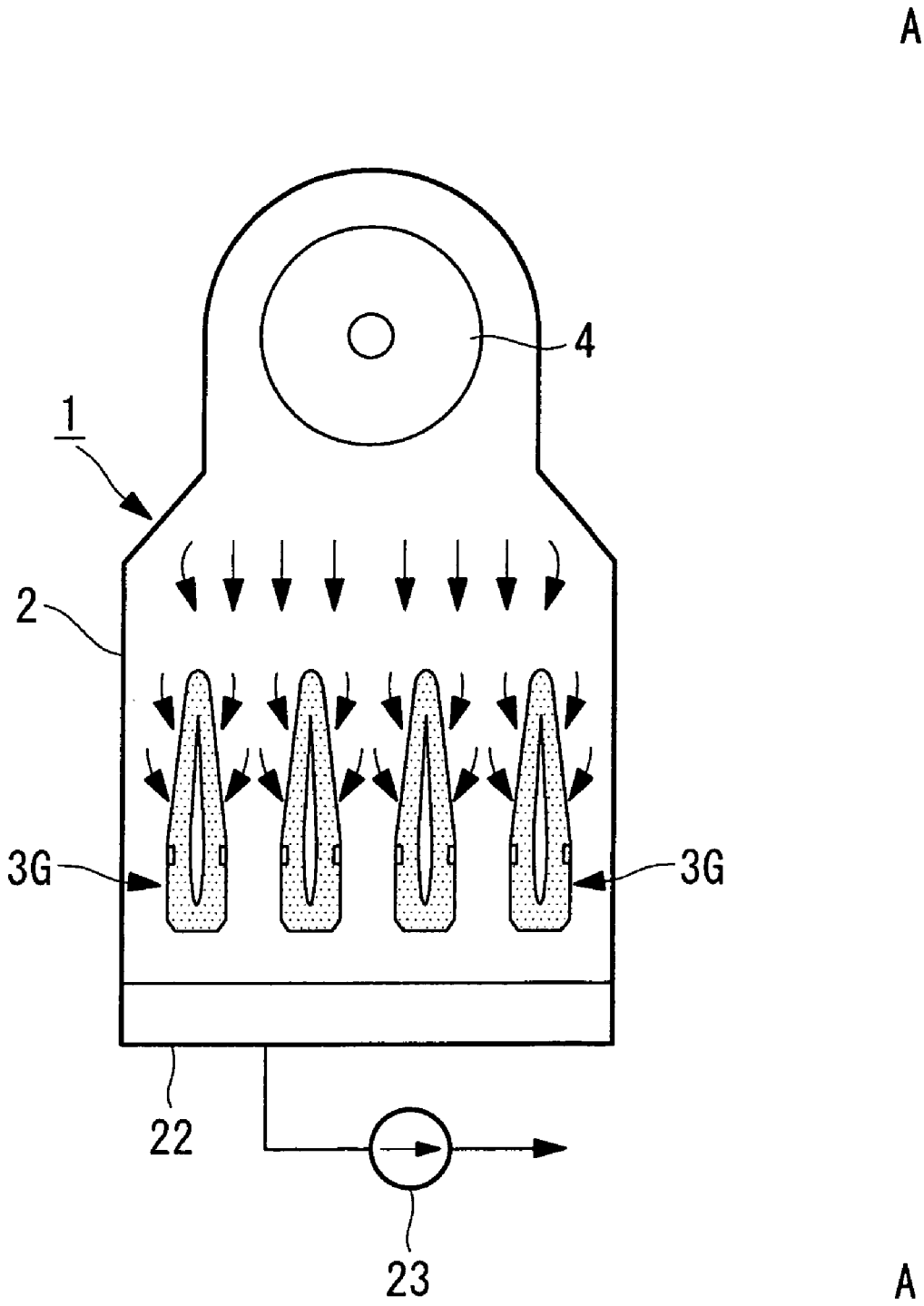
FIG. 2 is a sectional view taken along line A-A for explaining the structure of the condenser in FIG. 1.

FIG. 1 is a schematic view for explaining the structure of a condenser according to this embodiment. FIG. 2 is a sectional view taken along line A-A for explaining the structure of the condenser in FIG. 1.

A condenser 1 condenses the steam used to drive a steam turbine into water and supplies the condensate water again to a boiler etc., for generating steam. This embodiment will be described as applied to the condenser 1 to be used in thermal power plants and nuclear power plants.

As shown in FIGS. 1 and 2, the condenser 1 includes a shell (chassis) 2 that defines the exterior of the condenser 1 and cooling pipe groups 3G each including a collection of cooling pipes 3 for cooling steam.

As shown in FIGS. 1 and 2, the shell 2 has a water chamber 21 that, together with the cooling pipe groups 3G, forms paths through which cooling water circulates, and a hot well 22 that temporarily collects condensate water, i.e., water condensed from steam.

Furthermore, a turbine unit 4 of a steam turbine is disposed at the upper part of the shell 2, and the cooling pipe groups 3G are disposed below the turbine unit 4.

The turbine unit 4 is the last turbine unit into which the steam flows among a plurality of turbine units in the steam turbine. An example of the turbine unit 4 is a low-pressure turbine.

The water chamber 21 communicates with the cooling pipe groups 3G and supplies the cooling water to the cooling pipe groups 3G or receives the cooling water flowing from the cooling pipe groups 3G. Examples of the cooling water include water cooler than steam, such as sea water; it is not specifically limited.

The hot well 22 is disposed below the cooling pipe groups 3G and temporarily collects the condensate water condensed from steam. The condensate water in the hot well 22 is supplied to a steam generating portion for generating steam, such as a boiler, by a condensate water pump 23.

As shown in FIGS. 1 and 2, the plurality of cooling pipe groups 3G are disposed in the shell 2. The cooling pipe groups 3G are disposed between the turbine unit 4 and the hot well 22 so as to extend in the longitudinal direction of the shell 2, in other words, along the direction in which a rotation axis of the turbine unit 4 extends, and are disposed side by side in the left-right direction (left-right direction in FIG. 2).

The cooling pipe groups 3G may also be disposed so as to extend in the direction perpendicular to the rotation axis of the turbine unit 4. By appropriately choosing the arrangement of the cooling pipe groups 3G from the above-described arrangements in which the cooling pipe groups 3G extend in a direction perpendicular to the rotation axis and in which the cooling pipe groups 3G extend parallel to the rotation axis, restriction on their placement in a turbine house can be overcome.

Furthermore, as shown in FIG. 1, the cooling pipe groups 3G have a plurality of pipe-supporting plates 5 for supporting the cooling pipes 3. The pipe-supporting plates 5 are disposed at a distance from one another in a direction in which the cooling pipes 3 extend, and support the cooling pipe groups 3G such that they maintain the shape described below.

Figure 3:
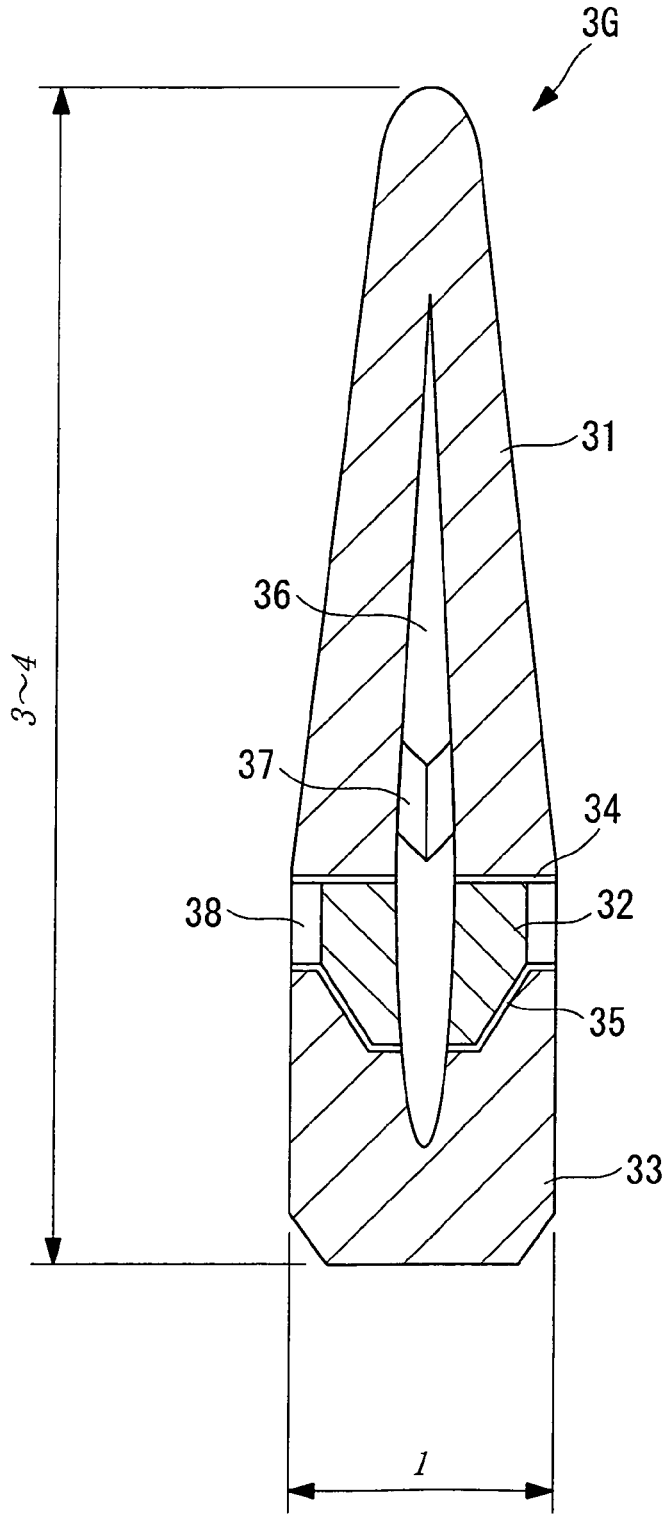
FIG. 3 is a sectional view for explaining the structure of a cooling pipe group in FIG. 2.

FIG. 3 is a sectional view for explaining the structure of the cooling pipe group in FIG. 2. A hatched area in FIG. 3 shows an area in which the cooling pipes 3 are disposed.

As shown in FIG. 3, the length of the cooling pipe group 3G is greater in the top-bottom direction than in the left-right direction. Furthermore, the cooling pipe group 3G has a tapered shape in which the length in the left-right direction decreases toward the upper portion.

This embodiment will be described as applied to the shape of the cooling pipe group 3G in which the length of the cooling pipe group 3G in the top-bottom direction is 3 or 4, where the length thereof in the left-right direction is assumed to be 1.

As shown in FIG. 3, the area, in the cooling pipe group 3G, where the cooling pipes 3 are disposed is divided into, from above, an upper heat exchange portion 31, an air cooling portion 32, and a lower heat exchange portion 33. An upper tray 34 is disposed between the upper heat exchange portion 31 and the air cooling portion 32, and a lower tray 35 is disposed between the air cooling portion 32 and the lower heat exchange portion 33.

Furthermore, as shown in FIG. 3, an inner steam path (inner channel) 36 surrounded by the cooling pipes 3, a water receiving tray (water receiving portion) 37, and an air extracting portion 38 are provided in the cooling pipe group 3G.

The upper heat exchange portion 31 and the lower heat exchange portion 33 cool and condense the steam into water (condensate water).

The upper heat exchange portion 31 is disposed at the upper part of the cooling pipe group 3G, and the steam flows from the outside of the upper heat exchange portion 31 toward the inner steam path 36, from above to below. The lower heat exchange portion 33 is disposed at the lower part of the cooling pipe group 3G, and the steam flows from the outside of the lower heat exchange portion 33 toward the inner steam path 36, from below to above.

The air cooling portion 32 cools the steam and non-condensable gas, such as air, having passed through the upper heat exchange portion 31 and the lower heat exchange portion 33.

The air cooling portion 32 is disposed between the upper heat exchange portion 31 and the lower heat exchange portion 33, and between the inner steam path 36 and the air extracting portion 38. The uncondensed steam and non-condensable gas having flowed through the inner steam path 36 pass through the air cooling portion 32 into the air extracting portion 38.

The upper tray 34 is a plate-like member that extends in a direction in which the cooling pipes 3 extend (a direction perpendicular to the plane of FIG. 3) and divides the upper heat exchange portion 31 and the air cooling portion 32.

The lower tray 35 is, similarly to the upper tray 34, a plate-like member that extends in the direction in which the cooling pipes 3 extend (the direction perpendicular to the plane of FIG. 3) and divides the air cooling portion 32 and the lower heat exchange portion 33.

The inner steam path 36 is a channel that is surrounded by the cooling pipes 3 and extends both in the top-bottom direction and the direction in which the cooling pipes 3 extend (the direction perpendicular to the plane of FIG. 3). The inner steam path 36 is also a channel into which the uncondensed steam and non-condensable gas having flowed through the upper heat exchange portion 31 and the lower heat exchange portion 33 flow, as well as a channel that guides the uncondensed steam and the like to the air cooling portion 32.

Figure 4:
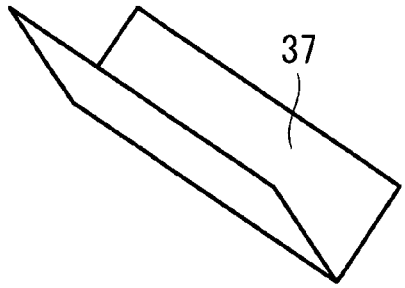
FIG. 4 is a schematic view for explaining the shape of a water receiving tray in FIG. 3.
Figure 5:
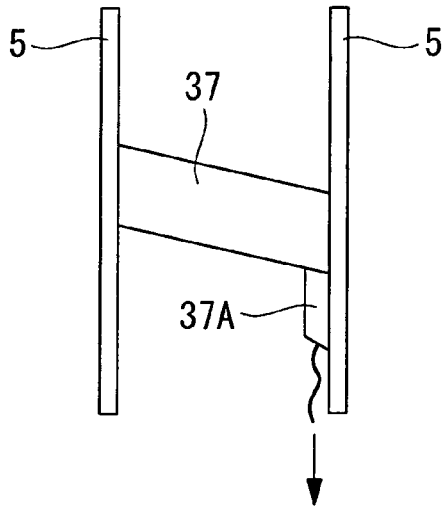
FIG. 5 is a schematic view for explaining the placement of the water receiving tray in FIG. 3.

FIG. 4 is a schematic view for explaining the shape of the water receiving tray in FIG. 3. FIG. 5 is a schematic view for explaining the placement of the water receiving tray in FIG. 3.

As shown in FIGS. 3 to 5, the water receiving tray 37 is disposed in an area, in the inner steam path 36, surrounded by the upper heat exchange portion 31.

The water receiving tray 37 is a plate member that has a substantially V-shaped cross section and is disposed with the opening of the V shape facing upward. Furthermore, the water receiving tray 37 is disposed so as to connect adjoining pipe-supporting plates 5 and is inclined downward from-one pipe-supporting plate 5 to another pipe-supporting plate 5.

As shown in FIG. 5, a lower end of the water receiving tray 37 (end on the right side in FIG. 5) has a discharge portion 37A that allows the condensate water having flowed down the water receiving tray 37 to be discharged downward along the pipe-supporting plate 5.

As shown in FIG. 3, the air extracting portion 38 is a channel that guides uncondensed steam and non-condensable gas, such as air, having passed through the air cooling portion 32 to the outside.

The air extracting portion 38 is a channel extending along the cooling pipes 3 and is disposed between the upper heat exchange portion 31 and the lower heat exchange portion 33, on the outside of the air cooling portion 32.

The operation of the condenser 1 having the above-described structure will be described below.

As shown in FIGS. 1 and 2, the steam having been used to drive the turbine unit 4 of the steam turbine flows from the turbine unit 4 toward the cooling pipe groups 3G, in the shell 2.

As shown in FIG. 3, the steam flows into the upper heat exchange portion 31 and the lower heat exchange portion 33 of the cooling pipe group 3G and is cooled by the cooling water flowing through the cooling pipes 3. The cooled steam is condensed on the surfaces of the cooling pipes 3 into water.

The water condensed on the surfaces of the cooling pipes 3 in the upper heat exchange portion 31 falls by gravity. In particular, the water condensed above the inner steam path 36 falls in the inner steam path 36.

The water that has fallen in the inner steam path 36 is received by the water receiving tray 37 and, as shown in FIG. 5, flows down the water receiving tray 37 toward the pipe-supporting plate 5. The water having flowed down the water receiving tray 37 falls downward from the water receiving tray 37 at the discharge portion 37A and flows down the pipe-supporting plate 5 into the hot well 22.

Similarly, the water condensed on the surfaces of the cooling pipes 3 in the lower heat exchange portion 33 falls into the hot well 22 by gravity.

As shown in FIG. 2, the water that has fallen into the hot well 22 is sent to a boiler or the like by the condensate water pump 23.

On the other hand, as shown in FIG. 3, the uncondensed steam and non-condensable gas, such as air, having passed through the upper heat exchange portion 31 and the lower heat exchange portion 33, flow into the inner steam path 36.

The uncondensed steam and the like having flowed from the upper heat exchange portion 31 into the inner steam path 36 flow downward inside the inner steam path 36 and flow into the air cooling portion 32. The uncondensed steam and the like having flowed from the lower heat exchange portion 33 into the inner steam path 36 flow upward inside the inner steam path 36 into the air cooling portion 32.

The uncondensed steam and the like having flowed into the air cooling portion 32 are further cooled by the cooling water flowing through the cooling pipes 3 in the air cooling portion 32. A part of the uncondensed steam is condensed into water and falls into the hot well 22.

The steam and non-condensable gas that are not condensed even at the air cooling portion 32 flow from the air cooling portion 32 into the air extracting portion 38 and are discharged outside the shell 2.

In the above-described structure, by receiving the water falling from the cooling pipes 3 with the water receiving tray 37 and allowing the water to flow down the pipe-supporting plate 5, a decrease in heat exchange capacity of the cooling pipes 3 disposed at a lower part can be prevented. That is, the condensation performance of the condenser 1 can be improved.

More specifically, the steam introduced in the shell 2 is cooled on the surfaces of the cooling pipes 3 by heat exchange with the cooling water and is condensed into water. The condensate water falls from the surfaces of the cooling pipes 3 and is received by the water receiving tray 37. The received water flows along the inclination of the water receiving tray 37 toward the pipe-supporting plate 5 and flows down the surface of the pipe-supporting plate 5.

Thus, the water condensed by the cooling pipes 3 disposed at an upper part is prevented from depositing on the cooling pipes 3 disposed at a lower part. That is, formation of a film of deposited water on the cooling pipes 3 disposed at a lower part is prevented, preventing a decrease in heat exchange efficiency due to the film.

By forming the water receiving tray 37 in a substantially V shape cross section, the water received by the water receiving tray 37 gathers at the bottommost position of the substantially V-shaped cross section and flows toward the pipe-supporting plate 5. Thus, the water received by the water receiving tray 37 can be assuredly guided to the pipe-supporting plate 5.

Figure 6:
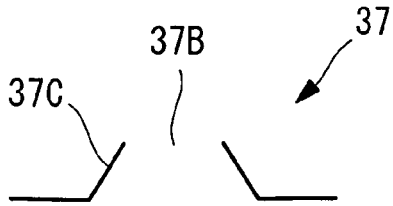
FIG. 6 is a partial sectional view for explaining the water receiving tray in FIG. 4 according to another example.

FIG. 6 is a partial sectional view for explaining the water receiving tray in FIG. 4 according to another example.

The water receiving tray 37 may be formed from a plate-like member that is bent in a substantially V shape as in the above-described embodiment, or, as shown in FIG. 6, the plate-like member bent in a substantially V shape may have a plurality of through-holes 37B and projections 37C formed by causing the circumferences of the through-holes 37B to protrude upward; it is not specifically limited.

By doing this, a fluid, such as uncondensed steam, flowing from above to below in the area where the water receiving tray 37 is disposed flows through the through-holes 37B. This makes it easier for fluid, such as steam, to flow through the inner steam path 36, compared with a case where the through-holes 37B are not provided.

On the other hand, the water received by the water receiving tray 37 flows so as to avoid the through-holes 37B because of the projections 37C when flowing down the plate-like member of the water receiving tray 37.

Thus, as well as preventing blocking of steam flow in the shell 2, it is possible to prevent a decrease in heat exchange capacity of the cooling pipes 3 disposed below the water receiving tray 37.

[Second Embodiment]

A second embodiment of the present invention will be described below with reference to FIGS. 7 to 9.

A condenser according to this embodiment has the same basic structure as that according to the first embodiment, except for the structure of the water receiving tray. Thus, in this embodiment, the portion around the water receiving tray will be described with reference to FIGS. 7 to 9, and explanations of the other components, etc., will be omitted.

Figure 7:
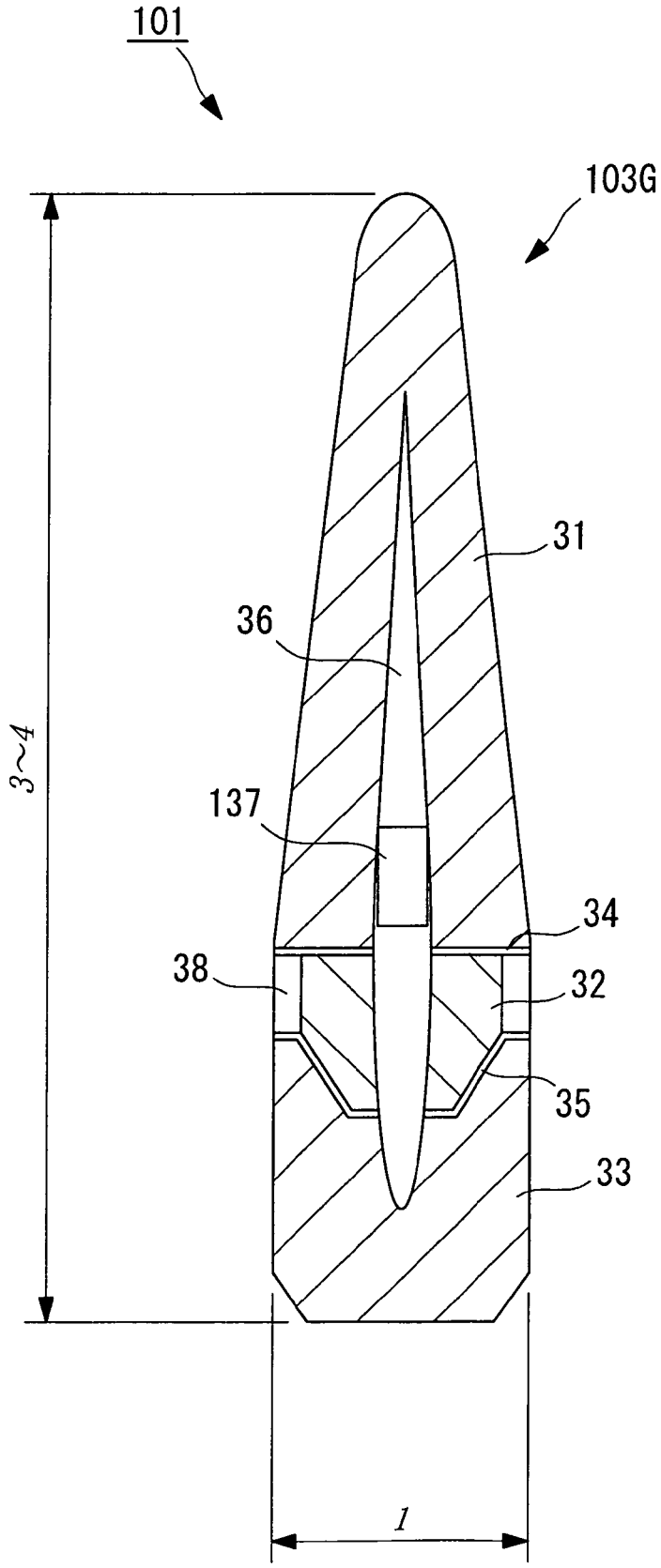
FIG. 7 is a schematic view for explaining the structure of a cooling pipe group of a condenser according to a second embodiment of the present invention.

FIG. 7 is a schematic view for explaining the structure of a cooling pipe group of a condenser according to this embodiment. The hatched area in FIG. 7 shows an area where the cooling pipes 3 are disposed.

The same components as those according to the first embodiment are denoted by the same reference numerals and explanations thereof will be omitted.

As shown in FIG. 7, a cooling pipe group 103G of the condenser 101 is divided into, from above, the upper heat exchange portion 31, the air cooling portion 32, and the lower heat exchange portion 33. The upper tray 34 is disposed between the upper heat exchange portion 31 and the air cooling portion 32, and the lower tray 35 is disposed between the air cooling portion 32 and the lower heat exchange portion 33.

Furthermore, as shown in FIG. 7, the inner steam path 36 surrounded by the cooling pipes 3, a water receiving tray (water receiving portion) 137, and the air extracting portion 38 are provided in the cooling pipe group 103G.

Figure 8:
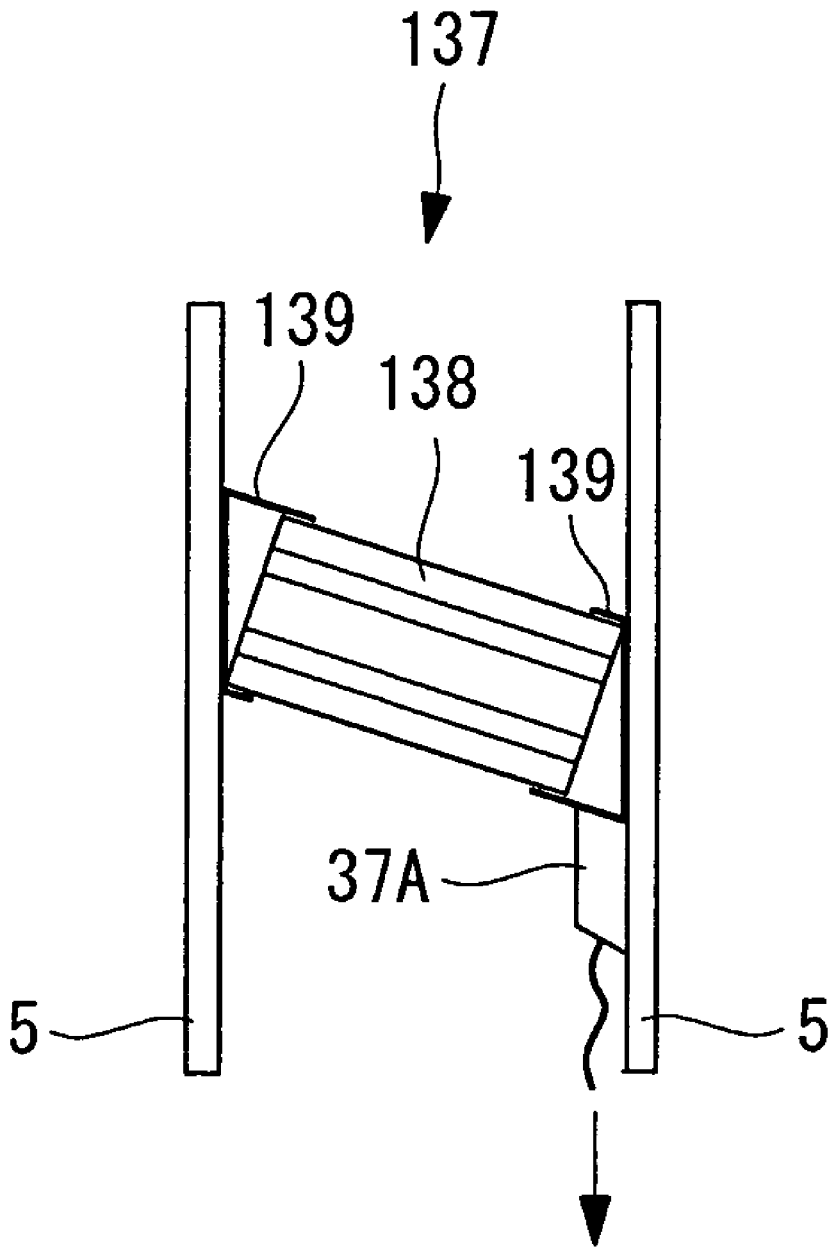
FIG. 8 is a schematic view for explaining the placement of a water receiving tray in FIG. 7.

FIG. 8 is a schematic view for explaining the placement of the water receiving tray in FIG. 7. FIG. 9 is a schematic view for explaining the structure of the water receiving tray in FIG. 7.

As shown in FIG. 7, the water receiving tray 137 is disposed in an area, in the inner steam path 36, surrounded by the upper heat exchange portion 31.

Figure 9:
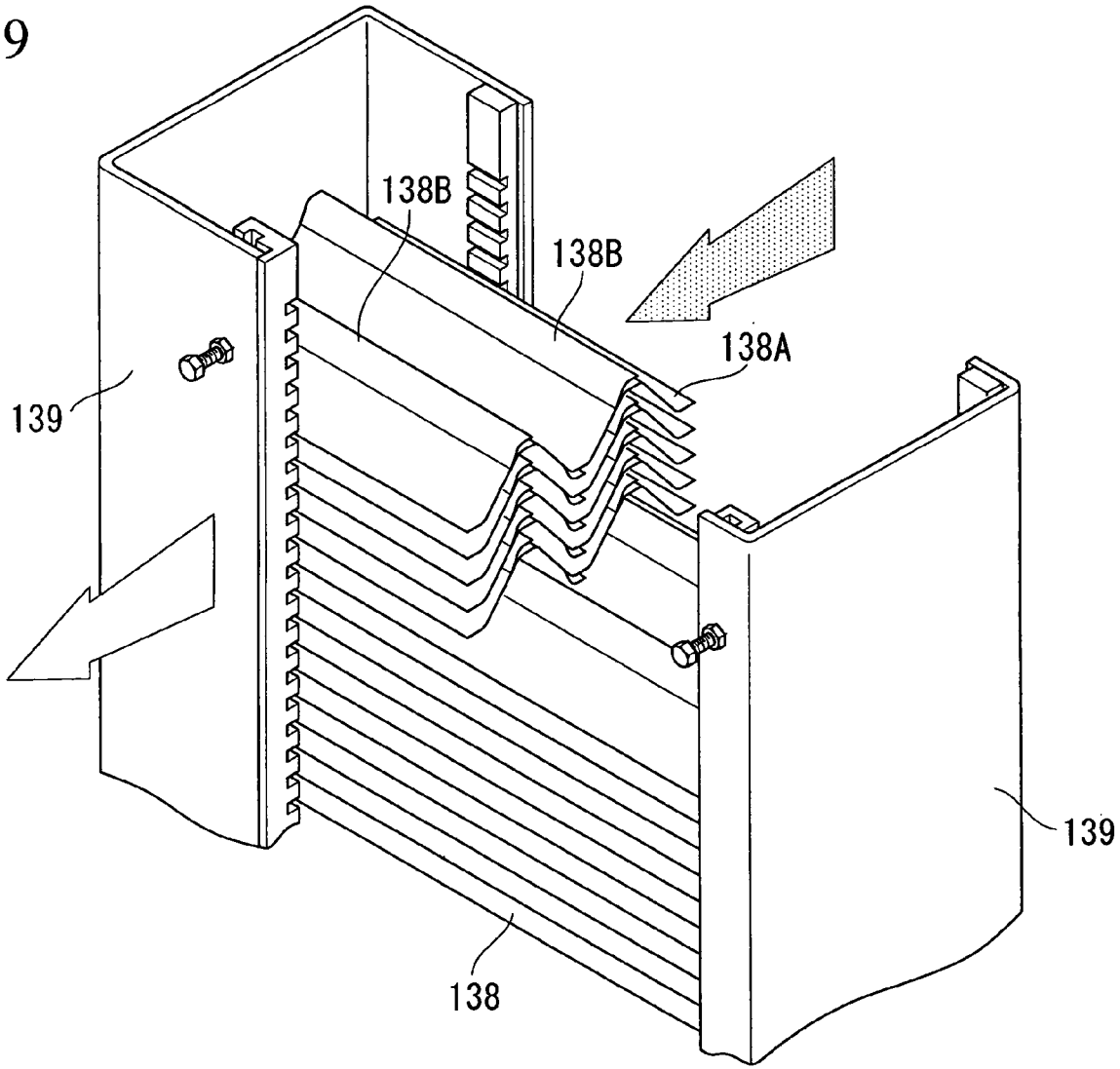
FIG. 9 is a schematic view for explaining the structure of the water receiving tray in FIG. 7.

As shown in FIGS. 8 and 9, the water receiving tray 137 includes chevron vanes 138, frames 139, and the discharge portion 37A.

As shown in FIG. 9, the chevron vanes 138 each include, in a sectional view substantially parallel to the pipe-supporting plates, a plurality of corrugated portions 138A that extend in the top-bottom direction (top-bottom direction in FIG. 9) and are bent in a corrugated form, the corrugated portions 138A being disposed side by side in the left-right direction (left-right direction in FIG. 9), and branched portions 138B that are provided near the corrugated portions 138A and extend upward in a direction away from the corrugated portions 138A.

As shown in FIG. 8, the chevron vanes 138 are disposed so as to connect the adjoining pipe-supporting plates 5 and is inclined downward from one pipe-supporting plate 5 to another pipe-supporting plate 5.

As shown in FIGS. 8 and 9, the frames 139 are components that are disposed between the pipe-supporting plates 5 and the chevron vanes 138, and as well as being attached to the pipe-supporting plates 5, also fix the chevron vanes 138 to the pipe-supporting plates 5.

The discharge portion 37A is a component that is disposed at the frame 139 at the lower end of the chevron vanes 138 (the right end in FIG. 8) and discharges the condensate water flowing from the chevron vanes 138 downward along the pipe-supporting plates 5.

The operation of the condenser 101 having the above-described structure will be described below.

As shown in FIG. 7, the steam flows in the upper heat exchange portion 31 and the lower heat exchange portion 33 of the cooling pipe group 103G and is cooled by the cooling water flowing through the cooling pipes 3. The cooled steam is condensed on the surfaces of the cooling pipes 3 into water.

The water condensed above the inner steam path 36 falls in the inner steam path 36.

As shown in FIGS. 8 and 9, the water that has fallen in the inner steam path 36 is received by the corrugated portions 138A of the water receiving tray 137. The water received by the corrugated portions 138A flows down the corrugated portions 138A and enters spaces between the corrugated portions 138A and the branched portions 138B. The water then flows in the spaces toward the pipe-supporting plate 5. The water having flowed toward the pipe-supporting plate 5 falls downward from the water receiving tray 37 at the discharge portion 37A and flows down the pipe-supporting plate 5 into the hot well 22.

Similarly, the water condensed on the surfaces of the cooling pipes 3 in the lower heat exchange portion 33 falls into the hot well 22 by gravity.

The water that has fallen into the hot well 22 is, as shown in FIG. 2, sent to a boiler or the like by the condensate water pump 23.

On the other hand, as shown in FIG. 7, the uncondensed steam and non-condensable gas, such as air, having passed through the upper heat exchange portion 31 and the lower heat exchange portion 33 flow into the inner steam path 36.

The uncondensed steam and the like having flowed from the upper heat exchange portion 31 into the inner steam path 36 flow downward inside the inner steam path 36 and flow through the water receiving tray 137 into the air cooling portion 32. The uncondensed steam and the like having flowed from the lower heat exchange portion 33 into the inner steam path 36 flow upward inside the inner steam path 36 into the air cooling portion 32.

As shown in FIG. 9, the uncondensed steam and the like pass through the water receiving tray 137, between the corrugated portions 138A extending in the top-bottom direction.

The uncondensed steam and the like having flowed into the air cooling portion 32 are further cooled by the cooling water flowing through the cooling pipes 3 in the air cooling portion 32. Thus, a part of the uncondensed steam is condensed into water and falls into the hot well 22.

The steam and non-condensable gas that are not condensed even at the air cooling portion 32 flow from the air cooling portion 32 into the air extracting portion 38 and are discharged outside the shell 2.

In the above-described structure, fluid, such as steam, flowing from above to below in the area where the water receiving tray 137 is disposed flows so as to pass between the corrugated portions 138A.

On the other hand, the water that has fallen from the surfaces of the cooling pipes 3 disposed above the water receiving tray 137 is received by the corrugated portions 138A and flows down the surfaces thereof, and then enters the spaces between the corrugated portions 138A and the branched portions 138B.

Otherwise, the water is directly received between the corrugated portions 138A and the branched portions 138B. The water between the corrugated portions 138A and the branched portions 138B flows toward the other pipe-supporting plate 5 and flows down the other pipe-supporting plate 5.

The frames 139 may be used to fix the chevron vanes 138 to the pipe-supporting plates 5 as described above, or the chevron vanes 138 may be directly fixed to the pipe-supporting plates 5 by welding or the like; it is not specifically limited.

What is claimed is:

1. A condenser comprising:

a plurality of cooling pipes, being disposed in a chassis to which a steam is introduced, through the interior of which cooling water used for heat exchange with the steam flows;

an inner channel that extends in a top-bottom direction and that is surrounded by the plurality of cooling pipes;

a plurality of pipe-supporting plates disposed at a distance from one another in a direction in which the plurality of cooling pipes extend to support the plurality of cooling pipes; and a water receiving portion disposed between the plurality of pipe-supporting plates and being inclined downward from one pipe-supporting plate to the other pipe-supporting plate.

2. The condenser according to claim 1, wherein the water receiving portion is provided inside the inner channel.

3. The condenser according to claim 1, wherein the water receiving portion is a plate-like member that is bent in a substantially V shape in a sectional view substantially parallel to the pipe-supporting plates.

4. The condenser according to claim 3, wherein the plate-like member of the water receiving portion has a through-hole penetrating in the top-bottom direction and a projection protruding upward from the circumference of the through-hole.

5. The condenser according to claim 1, wherein the water receiving portion includes, in a sectional view substantially parallel to the pipe-supporting plates:

a plurality of corrugated portions, extending in a top-bottom direction and being bent in a corrugated form, which are disposed side by side in a left-right direction; and branched portions that are provided near apexes of the corrugated portions and extend upward in a direction away from the corrugated portions.

* * * * *